US005357270A

United States Patent [19]

Herbert

[11] Patent Number: 5,357,270

[45] Date of Patent: Oct. 18, 1994

[54] THERMAL TRANSFER PRINTING

[75] Inventor: Raymond J. Herbert, Leigh-on-Sea, United Kingdom

[73] Assignee: Neopost Limited, Essex, United Kingdom

[21] Appl. No.: 953,771

[22] Filed: Sep. 30, 1992

Related U.S. Application Data

[63] Continuation of Ser. No. 629,570, Dec. 18, 1990, abandoned.

[30] Foreign Application Priority Data

Dec. 22, 1989 [GB] United Kingdom ..... 8928990.4

[51] Int. Cl.[5] ..... B41J 2/315

[52] U.S. Cl. ..... 346/76 PH; 347/61

[58] Field of Search ..... 346/76 PH, 1.1; 400/120, 232

[56] References Cited

U.S. PATENT DOCUMENTS

| | | | |
|---|---|---|---|
| 4,739,343 | 4/1988 | Dolan | 346/76 PH |
| 4,746,234 | 5/1988 | Harry | 346/76 PH |
| 4,917,010 | 4/1990 | Gilham et al. | 346/76 PH |

*Primary Examiner*—Benjamin R. Fuller
*Assistant Examiner*—Huan Tran
*Attorney, Agent, or Firm*—Shoemaker and Mattare, Ltd.

[57] ABSTRACT

A method of improving the quality of printed impression obtained from thermal transfer printing on a print receiving medium having a poor print receiving surface is disclosed. A thermal transfer ribbon is fed with the print receiving medium and during feeding thereof thermal printing elements are energized selectively to print a required impression. The selected elements are energized repeatedly in a sequence of printing cycles to cause re-heating of the transfer ribbon to ensure that ink required to be transferred but not received successfully by the medium in one cycle is successfully received in a subsequent cycle.

12 Claims, 5 Drawing Sheets

FIG.1.
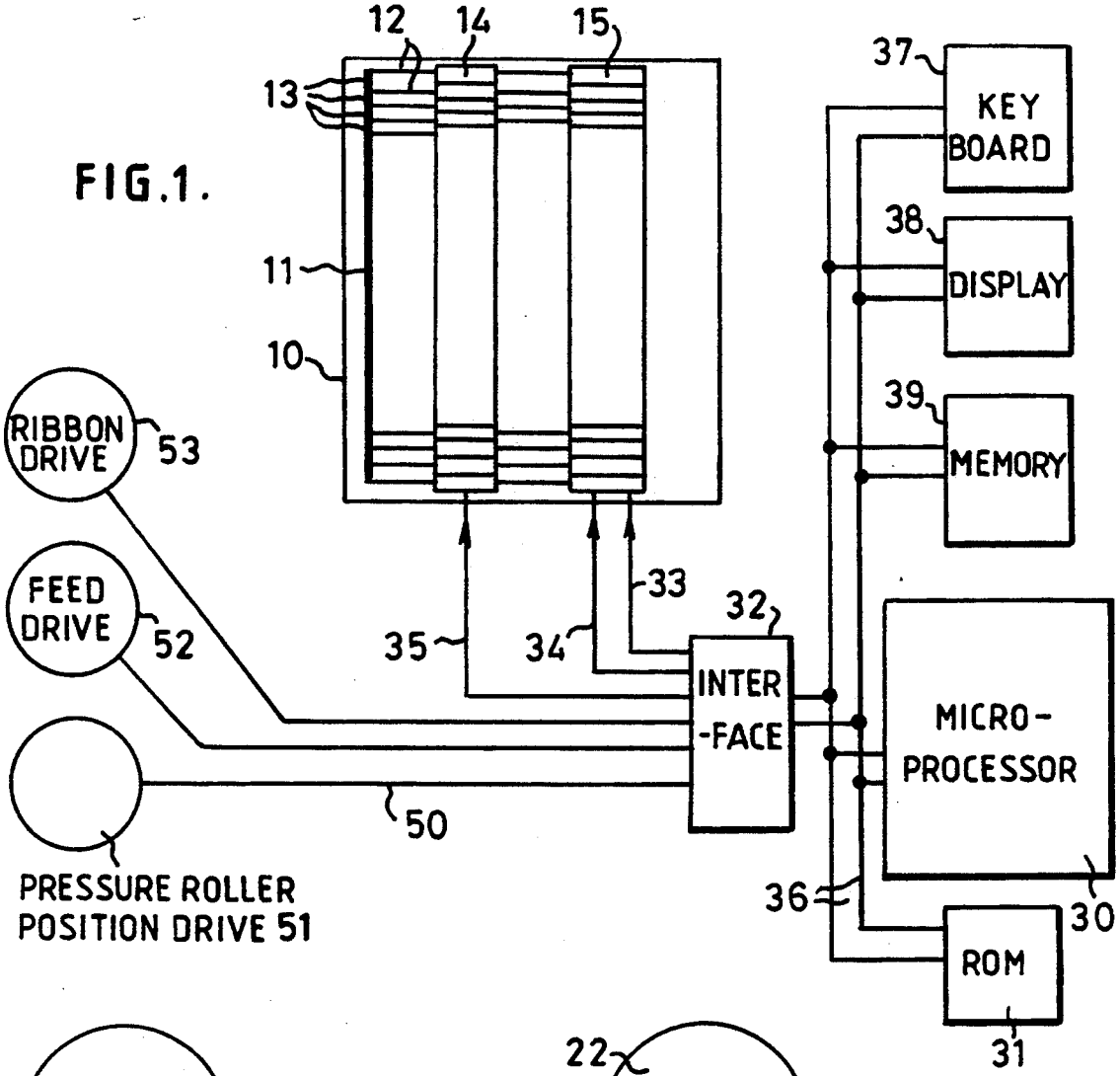
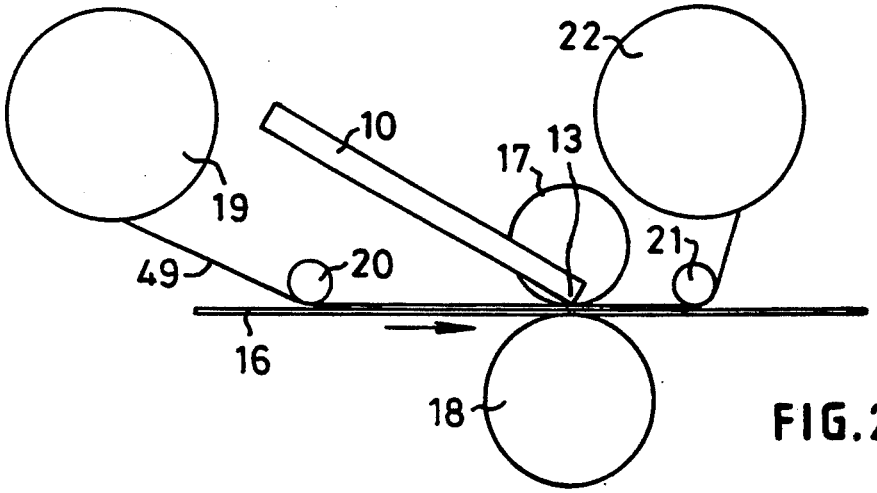
FIG.2.

THERMAL TRANSFER PRINTING

This is a continuation of copending application Ser. No. 07/629,570, filed on Dec. 18, 1990, now abandoned.

BACKGROUND OF THE INVENTION

This invention relates to printing using a thermal print head in which elements of the head are selectively heated by electric current to cause transfer of ink from a thermal ink transfer ribbon to a medium on which printing is to be effected.

Thermal printers are known which comprise a row of print elements consisting of thin or thick film resistors deposited on a substrate. Usually the resistors are formed as a single resistive strip and the individual resistive printing elements are defined by electrical connections to the strip at spaced points along the length thereof, the portion of strip between two adjacent connection points forming an element. A thermal ink transfer ribbon consisting of a film carrying a layer of ink is positioned between the print elements and a medium on which printing is to be effected, the ink layer being adjacent the medium. A pressure roller urges the medium into contact with the ink layer and the ribbon into contact with the print elements so that when any print element is heated by electric current passed therethrough, by way of the electrical connections defining that element, the ink layer in the region of that heated element is softened and caused to adhere to the surface of the medium. The medium and the ribbon are fed past the row of print elements and during this movement the print elements are selectively and repeatedly heated such as to cause a desired pattern to be printed row by row. The quality of the printing obtained is dependent to some extent upon the properties of the surface of the medium and if the medium has a rough surface the transfer of ink from the ribbon to the medium may be non-uniform and as a result the quality of the printing may be poor. In many situations where thermal print heads are utilised in a thermal transfer printing process it is possible to specify the physical properties required for the surface of the medium and thereby ensure attainment of the desired quality of printing. However in machines for printing postal franking on mail items it is not possible to ensure that the surface of all mail items will have the required properties. Generally envelopes have a satisfactory surface but users of franking machines may decide to use envelopes having a surface on which it is difficult to attain a desired high quality of printing. It is a requirement that postal franking machines should be capable of printing satisfactorily on all types of envelopes available to the user of the machine.

SUMMARY OF THE INVENTION

According to one aspect of the invention a thermal transfer printing device comprises a plurality of dot printing elements disposed in a row; said dot printing elements being selectively heatable to transfer ink from a thermal transfer ink ribbon to a print receiving medium to print dots corresponding to said elements; means select elements of said plurality of elements; means repeatedly heat the selected elements a plurality of times to effect transfer of ink from the thermal transfer ink ribbon to the print receiving medium; and means to feed a print receiving medium past the row of printing elements in a direction transverse to the row at a speed such that the repeated heating of the selected elements results printing of a plurality of overlapping dots.

According to a second aspect of the invention a method of thermal transfer printing in which ink is transferred from a ribbon carrying ink to a print receiving medium by heating of selected areas of the ribbon includes the steps of repeatedly heating each of said selected areas a plurality of times to ensure that the required transfer of ink is effected to produce a high quality print impression on the medium.

According to a third aspect of the invention a method of thermal transfer printing onto a print receiving medium having a surface which tends to produce a poor quality of printing wherein ink is transferred from a ribbon carrying ink to the print receiving medium by heating of selected areas of the ribbon includes the steps of repeatedly heating each of the selected areas a plurality of times so that ink in the selected areas of the ribbon which is not accepted by the surface of the medium in a first heating of the selected areas is transferred and accepted by the surface of the medium in a subsequent heating of the areas.

According to a fourth aspect of the invention in a method of thermal transfer printing in which an ink containing layer of a thermal transfer ink ribbon is brought into contact with the surface of a print receiving medium and is fed with the print receiving medium past selectively heatable printing elements of a thermal printing head and in which selected ones of said printing elements are heated to heat selected areas of the ink containing layer to effect deposition of ink from said selected areas of the ink layer onto corresponding areas of the surface of the print receiving medium said selected ones of said printing elements are re-heated to heat at least a part of each selected area of the ink layer to effect further deposition of ink from said areas onto said corresponding areas of the print receiving medium.

According to a fifth aspect of the invention in a method of thermal transfer printing in which an ink containing layer of a thermal transfer ink ribbon is brought into contact with the surface of a print receiving medium and is fed with the print receiving medium past selectively heatable printing elements of a thermal printing head and in which in a first printing cycle selected ones of said printing elements are heated to heat selected areas of the ink containing layer to effect deposition of ink from said selected areas of the ink layer onto corresponding areas of the surface of the print receiving medium and in which due to defective adherence of the ink to the surface of the print receiving medium portions of the corresponding areas do not receive ink and including the step in a second printing cycle of re-heating said selected ones of said printing elements to heat a part of each selected area of the ink layer to effect deposition of ink remaining in said areas onto said portions of said corresponding areas of the print receiving medium.

BRIEF DESCRIPTION OF THE DRAWING

An embodiment of the invention will now be described by way of example with reference to the drawings in which:

FIG. 1 illustrates the selectively heatable print elements and electrical connections of a thermal print head together with a block diagram of a circuit for controlling operation of the print head, FIG. 2 illustrates means for feeding a medium and thermal ink transfer ribbon past the thermal print head, FIG. 3(*a*) illustrates to a greatly enlarged scale the relationship between a print element and the area of print effected thereby, FIG. 3(*b*) shows the elongation of the area of print due to movement of the print receiving medium, FIG. 3(*c*) shows a heating/cooling cycle of the print element, FIG. 4(*a*), 4(*b*), 4(*c*) and 4(*d*) illustrate transfer of ink in a sequence of printing cycles, FIG. 5(*a*) and 5(*b*) illustrate printing with high resolution.

DESCRIPTION OF THE PREFERRED EMBODIMENT

Figure 3:
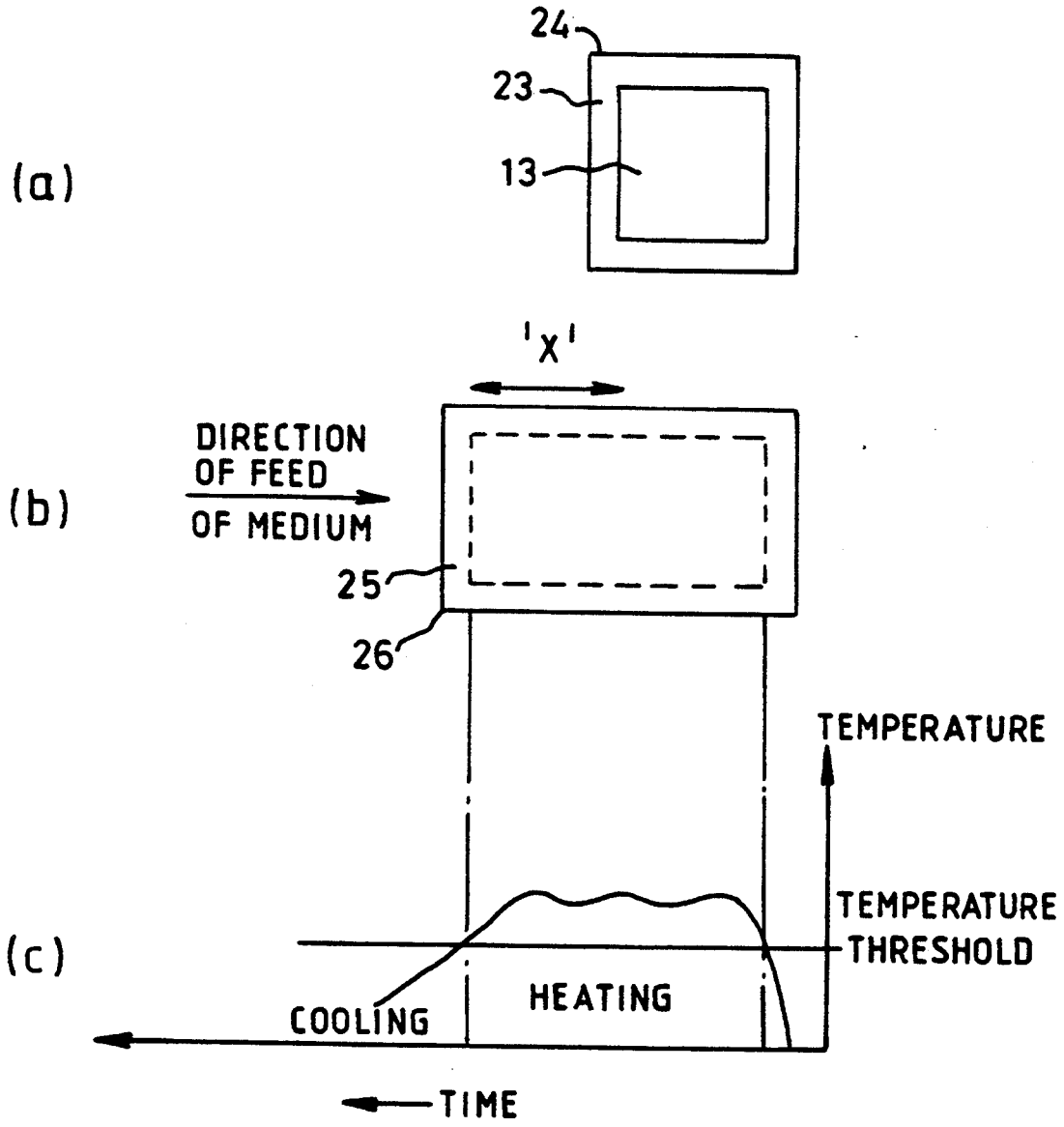

Referring first to FIG. 1, a thermal print head comprises a substrate 10, which may be of ceramic, on which is deposited a strip 11 of electrically resistive material. Electrical connections 12 are made to the resistive strip at points spaced apart along the length of the strip so as to define a plurality of resistive elements 13 disposed in a row across the substrate. The electrical connections are connected to a plurality of latch driver circuits 14 which in turn are controlled by corresponding memory locations of a print buffer register 15. For clarity in the drawing only a few of the connections 12, elements 13, driver circuits 14 and memory locations are illustrated. Printing is effected by writing print data, the bits of which represent dot positions of a row of a pattern to be printed, into the buffer register 15. The bits of the print data are read out in parallel from the locations of the register to the driver circuits 14. The driver circuits 14 are operated by a strobe signal to energise and thereby heat the elements in correspondence to the bits of the print data. The print data comprises a string of binary bits, each bit position corresponding to a different one of the print elements 13, and for example the bits having binary value '1' cause heating of the corresponding element whereas bits having binary value '0' do not cause heating of the corresponding elements. It will be appreciated that in order to print a complete pattern, the cycle of loading print data into the register 15 and operating the latch drivers to heat selected ones of the print elements must be repeated a number of times while relative movement between the print head and the medium takes place. The operation of the print head is controlled by a microprocessor 30 operating under a program routine stored in a read only memory (ROM) 31. Print data signals, a read out signal for enabling read out of the print data from the buffer 15 and the strobe signal to operate the driver circuits 14 are output by the microprocessor 30 through an input/output interface 32 onto lines 33, 34, 35 respectively. The ROM 31 and interface 32 are connected to the microprocessor by means of a bus 36. It is envisaged that the print head and control circuit therefor are part of a franking machine for printing franking impressions on mail items. Accordingly a keyboard 37 for the input of data and control signals, a display device 38 for the display of information to a user and memory devices 39 for the storing of accounting data are connected to the microprocessor by means of the bus 36.

Generally, the print head is maintained stationary and the medium, together with a thermal transfer ribbon is moved past the print elements of the print head. FIG. 2 illustrates means for effecting this movement. The print head 10 is mounted with the print elements 13 adjacent a feed path for the medium 16 formed by a nip between feed rollers 17, positioned adjacent to each side of the print head, and a pressure roller 18. A thermal ink transfer ribbon 49 is drawn from a supply spool 19 past a guide 20 and then between the print head elements 13 and the medium 16 with the ink layer of the ribbon in contact with the medium. The ribbon is drawn from the supply spool by the frictional engagement between the ribbon and the medium 16. After passing the print head, the ribbon is guided by a guide 21 to a take up spool 22 which is driven to take up the used ribbon. The pressure roller 18 is sufficiently resilient as to ensure contact between the ink layer and the medium and to maintain the ribbon in good thermal contact with the elements of the print head across the entire width of the print head. The medium 16 may be a continuous web of material but when the printing device is utilised in a postage franking machine for printing franking impressions on envelopes, the medium will consist of individual envelopes fed one at a time past the print head. Preferably when used for feeding envelopes the pressure roller is retractable from the print head so that after completion of a franking impression the envelope is released for ejection from the machine so that the ribbon is fed only when an envelope is present and for a length only slightly longer than the length of the franking impression. Movement of the pressure roller 18 from its operative position to its retracted in-operative position and vice versa is controlled by means of a signal on line 50 (see FIG. 1) from the microprocessor 30 controlling operation of a pressure roller position drive 51. The feed rollers 17 are driven by a feed drive motor 52 controlled by the microprocessor 30.

When a print element 13 is energised by electrical current to cause heating thereof, the heat spreads outwards beyond the area of the element. This is illustrated in FIG. 3(*a*), in which a print element 13 is energised by an electrical current such that its temperature rises above a threshold. When the element is heated above the threshold temperature it is effective to melt the ink carried by the thermal transfer ribbon over an area greater than that of the element and this area is indicated as an area 23 bounded by line 24. Thus if the print head and the medium were stationary relative to one another, the print element 13 would print a dot having the dimensions of the area 23. As an example this outward spread may extend linearly by approximately 20% which would result in the area 23 being approximately 100% larger than the area of the print element 13. However it will be appreciated that the feeding of the medium past the print head will result in movement of the medium past the element while the element is heated above the threshold temperature. Accordingly during this heating period as shown in FIG. 3(*c*) the medium will travel through a distance 'x' as shown in FIG. 3(*b*). The effect of this is that the printed area 23 of FIG. 3(*a*) is smeared and elongated in the direction of movement of the medium and has the form of the rectangular area 25 bounded by line 26. The print resolution in the direction of movement of the medium is determined by the dimension of the print element, the speed of movement of the medium and the frequency of energising the elements. The frequency of energisation of the elements of the print head, i.e. the print cycle time of the head, is determined by the physical and electrical characteristics of the head. Currently the minimum time for the heating and cooling cycle is approximately 2 ms. The speed of movement of the medium past the print head is arranged such that, for a specific cycle time of the print head, the dots printed give an appearance of a continuous printed line.

If the surface of the medium is highly receptive to the transfer of ink from the ribbon to the medium, with a single strike ribbon substantially all the ink in the area of the ribbon subjected to heating above the melting point of the ink by the action of a heated print element is transferred from the ribbon to the surface of the medium. However if the characteristic of the surface is such that it is less receptive to transfer of ink, some of the ink will remain on the ribbon and will not be transferred to the medium.

Figure 4:
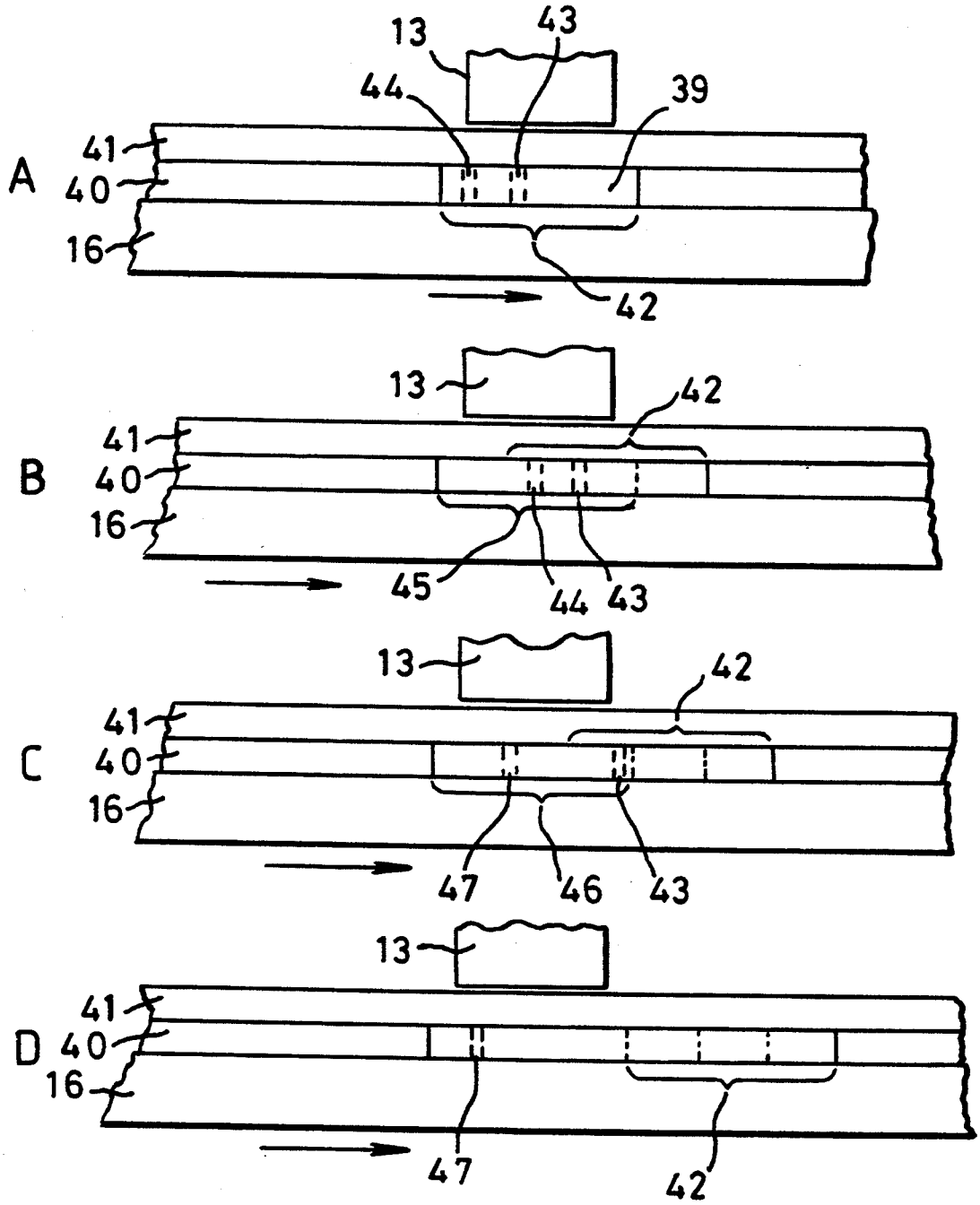

In order to ensure that substantially all of the ink in those areas of the ribbon subjected to heating above the melting point of the ink by the action of the heated print elements is transferred to the surface of a low quality medium, and thereby ensure high print quality, the medium is fed past the print head in such a manner as to subject each area of the ink required to be transferred to heating in a succession of heating cycles. Accordingly the speed of the drive motor 52 is controlled by the microprocessor 30 to drive the rollers 17 at a decreased speed so that speed of movement of the medium 16 and ribbon is decreased, for example to 1 mm/32 ms, while maintaining the print cycle time unchanged, for example at 2 ms. As a result the ink of the ribbon corresponding to each area to be printed is subjected to heating a plurality of times. Thus when using a single strike ribbon areas of ink which should have been transferred in one print cycle but have remained on the ribbon are likely to be transferred in one of the succeeding print cycles in which those areas are heated again. FIG. 4(*a*) illustrates the transfer of ink 39 from an ink layer 40 supported by a backing layer 41 in a first printing cycle. An area 42 is subjected to heating by the thermal print element 13 such that all the ink in the area 42 is capable of being transferred to the surface of the print receiving medium. However due to defective receptivity of ink by the surface of the medium portions 43, 44 of the ink layer fail to be transferred to the medium. FIG. 4(*b*) illustrates the transfer of ink in the next printing cycle. Feeding of the medium together with the ribbon has now moved the area 42 relative to the printing element 13 and a new area 45 is in a position such that it is subjected to heating by the element 13. The portions 43, 44 in which ink was not successfully transferred to the medium in the first printing cycle lie within the new area 45 are subjected to heating again so that ink in at least one of these portions may be successfully transferred to the medium. As an example it is assumed that successful transfer is effected in the area 44. Accordingly as shown in FIG. 4(*c*), immediately prior to heating of the element 13 in a third printing cycle, the medium and ribbon have moved further past the element 13 and an area 46 is to be subjected to heating by the element 13 in the third printing cycle. The. portion 43 lies within this area 46 and hence is subjected to heating again in the third printing cycle. Successful transfer of ink in the portion 43 is shown as having occurred by FIG. 4(*d*). It will be appreciated that in these successive printing cycles ink may not be successfully transferred from other portions 47. However these will be subjected to repeated heating in successive later printing cycles to improve the transfer of ink from these portions.

Figure 5:
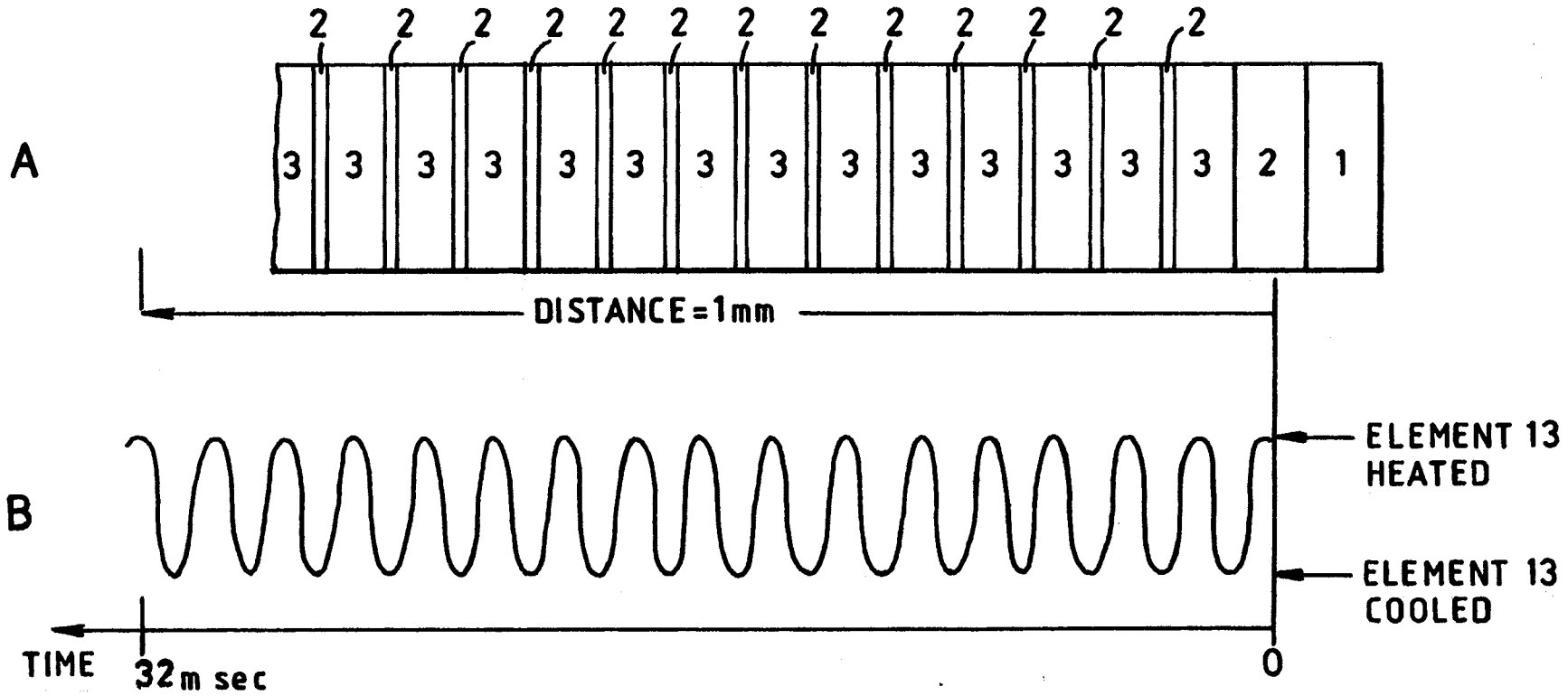

When using a multi-strike ribbon in which only a proportion of the ink is removed in each printing cycle, the successive printing cycles in which the areas of ribbon are subjected to successive heating will cause additional ink to be transferred in each cycle and hence any area intended to be printed but which has not received ink in one of the printing cycles is likely to receive ink in at least one of the succeeding cycles. As a result after a succession of printing cycles the entire printed areas will have received ink from the ribbon and there will not be any un-inked portions of the printed areas. Thus the printed area will be of a relatively uniform dense colour. When using a specific printing head, the feed rate of the print receiving medium may be reduced as compared with the normal feed rate so as to result in most of the area to be printed being overprinted three times as illustrated in FIG. 5(*a*), the numbers 1, 2 and 3 depicting the number of times each part of the ribbon is heated. FIG. 5(*b*) shows repetitive heating and cooling cycles of a print element. If the elongation of the print dot due to movement of the medium is ignored as shown in FIG. 5(*a*) there would be narrow bands in the area which would be overprinted only twice. However the elongation due to this movement ensures that these bands are overprinted three times.

It will be appreciated that the slower rate of feeding of the medium will result in a slower rate of printing. When a multi-strike ribbon is used, additional ink is removed from the ribbon in printing a pattern than for a normal rate of feeding of the medium. Therefore the number of times the ribbon can be re-used is reduced. In pending European patent application 88310170.1 there is described apparatus for feeding a multi-strike ribbon in which the ribbon is rewound, prior to the next printing operation, by a proportion of the length used during a preceding printing operation. The proportion is selected such that each part of the ribbon is presented a desired number of times for ink transfer. When overprinting is effected as described hereinbefore ink transfer is effected a number of times for each printing operation and hence the proportion of ribbon rewound will need to be changed to ensure that each part of the ribbon is presented for ink transfer the required number of times. Ribbon drive motors 53 for the winding and rewinding of the ribbon are controlled by the microprocessor 30. It is desirable to select the slower rate of feeding to cause successive overprinting as described hereinbefore only when the characteristics of the medium require such overprinting to be effected.

Figure 6:
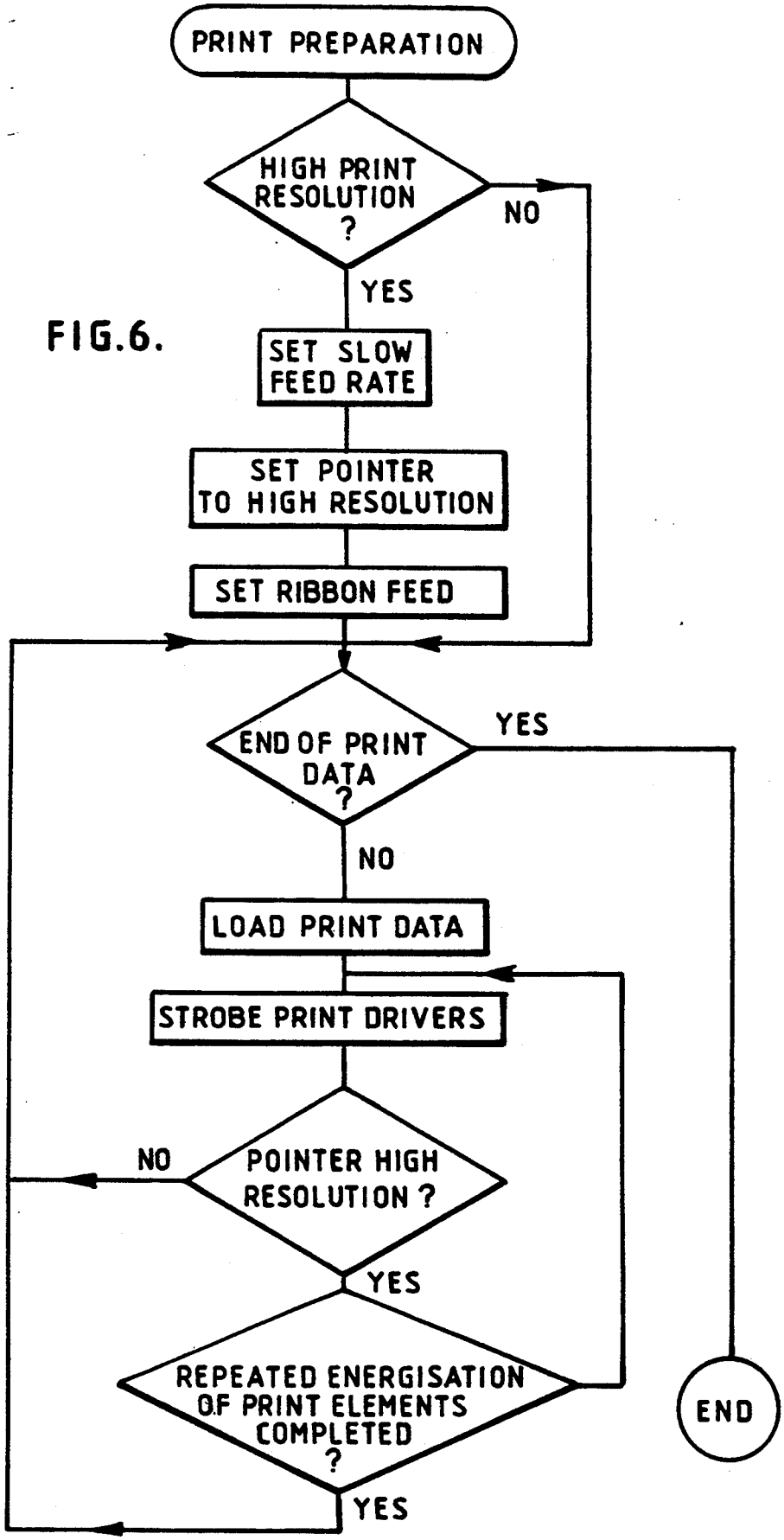
FIG. 6 is a flow chart relating to operation of the print head.

It is usually desirable to maintain a high printing rate and, when using multi-strike ribbons, to reduce ribbon usage. Accordingly apparatus arranged to permit slow feed rate with overprinting preferably has a default condition set up upon power up in which the high feed rate is selected. When a user desires to print upon a medium which requires the slow feed rate with overprinting to attain printing of sufficient quality, the user selects this option by operation of a key button switch on the keyboard 33. FIG. 6 is a flow chart illustrating a sequence of steps effected by a control device. At initiation of print preparation the microprocessor tests to determine whether the high resolution slow print rate has been selected by the user. If it has not been selected the control device continues with control of the printing device in the default condition. However if it has been selected the control device selects a slow feed rate for the feed of the medium past the print head, sets a print pointer to high resolution print data, sets the ribbon rewinding control to a suitable ratio of forward and reverse feed (when a multi-strike ribbon is used) and then continues with control of the printing device. The purpose of setting the print pointer is that the same print data is used to selectively energise the print elements in a number of successive print cycles when effecting overprinting whereas when printing at the default low resolution the print data is used only once to selectively energise the print elements in a single print cycle. The setting of the pointer is used to control the utilisation of the print data according to the resolution selected.

I claim:

1. A method of thermal transfer printing including the step of feeding a ribbon having an ink layer together with a print receiving medium at a speed equal to that at which said print receiving medium is fed relative to a thermal print head, said thermal print head including selectively heatable print elements, and the step of heating selected areas of said ink layer of said ribbon by heating selected ones of said print elements to effect ink transfer from said ink layer of said ribbon to said print receiving medium and including the steps of repeatedly heating said selected ones of said print elements a plurality of times and controlling the speed at which said ribbon and print receiving medium are fed to cause repeated heating of each of said selected areas a plurality of times and thereby to ensure that the required transfer of ink is effected to produce a high quality print impression on said print receiving medium 2. A method of thermal transfer printing onto a surface of a print receiving medium which surface tends to produce a poor quality of printing including the steps of bringing an ink layer carried by a ribbon into stationary ink transfer relationship relative to said surface of said print receiving medium and the step of transferring ink transferred from said ink layer carried by said ribbon to said surface of said print receiving medium during a relative motion between said ribbon and a print head by heating selected print elements of said print head to effect heating of selected areas of said ink layer of said ribbon and including the steps of repeatedly heating each of said selected print elements and controlling said relative motion between said ribbon and said print head so that said repeated heating of said selected print elements causes repeated heating of each of said selected areas a plurality of times and ink in said selected areas of said ink layer of said ribbon which is not received by said surface of said print receiving medium in a first heating of said selected areas by said heating of said selected print elements is transferred and received by said surface of said print receiving medium in a subsequent heating of said areas by said heating of said selected printed elements.

3. A method of thermal transfer printing in which an ink containing layer of a thermal transfer ink ribbon is brought into contact with a surface of a print receiving medium moving at a given speed and said ribbon is fed at said given speed with said print receiving medium past selectively heatable printing elements of a thermal printing head and in which in a first printing cycle selected ones of said selectively heatable printing elements are heated to heat selected areas of said ink containing layer to effect transfer of ink from said selected areas of said ink containing layer to corresponding areas of said surface of said print receiving medium and in which portions of said corresponding areas do not receive ink due to defective adherence of the ink to the surface of said print receiving medium and comprising the step of controlling said given speed at which said ribbon is fed with said print receiving medium past said selectively heatable printing elements and the step in a second printing cycle subsequent to said first printing cycle of re-heating said selected ones of said selectively heatable printing elements such as to heat a part of each of said selected areas of said ink layer to effect transfer of ink remaining in said selected areas to said portions of said corresponding areas of said print receiving medium.

4. A thermal transfer printing device comprising a plurality of dot print elements disposed in a row; feeding means to feed a print receiving medium at a low elements in a direction transverse to said row of dot print feed rate past said row of dot print elements; ribbon guiding means to guide a thermal transfer ink ribbon between said row of print elements and said print receiving medium, said thermal transfer ink ribbon having an ink layer located in ink transfer relationship with said print receiving medium; means to maintain said print receiving medium in engagement with said ink layer of said ribbon adjacent to said row of dot print elements and to draw said ribbon with said print receiving medium and at said low feed rate at which said print receiving medium is fed by said feeding means past said row of dot print elements; means to heat selected ones of said dot print elements in a first print cycle to effect transfer of ink from regions of said ink layer heated by said selected ones of said dot print elements to said print receiving medium and to heat said selected ones of said dot print elements again in a second print cycle at a predetermined time after said first print cycle and control means to control said low feed rate so as to effect transfer by said selected ones of said dot print elements to said print receiving medium in said second print cycle of ink remaining in said regions of said ink layer after heating of said regions by said selected ones of said dot print elements in said first print cycle.

5. A thermal transfer printing device as claimed in claim 4 wherein the thermal transfer ink ribbon is a single strike ribbon having a single ink layer and wherein the heating of the selected one of the dot print elements in the second print cycle causes ink which is not transferred from said single ink layer to the print receiving medium during heating of said selected one of said dot print elements in the first print cycle to be transferred in subsequent heating of said selected ones of said dot print elements in said second print cycle.

6. A thermal transfer printing device as claimed in claim 4 wherein the thermal transfer ink ribbon is a multi-strike ribbon having a plurality of layers of ink and wherein heating of the selected ones of the dot print elements in the second print cycle causes ink which is not transferred from one of said ink layers during heating of said selected ones of said dot print elements in the first print cycle to be transferred from at least one of said layers in the subsequent heating of said selected ones of said dot print elements in said second print cycle.

7. A thermal transfer printing device as claimed in claim 4 including a print data buffer store to store print data defining the selected ones of the dot print elements to be heated; means to load a block of data into said buffer store; means responsive to said print data block in said buffer store and operable by a strobe signal to heat simultaneously said selected ones of said dot print elements; control means to generate first and second said strobe signals to effect heating in the first and second printing cycles respectively to said selected ones of said dot printing elements defined by said print data block loaded in said print data buffer store.

8. A thermal transfer printing device as claimed in claim 4 including control means to control the feeding means to feed the print receiving medium and the ribbon at a high feed rate greater than the low feed rate and to heat the selected ones of the dot print elements at predetermined intervals and said control means being selectively operable to control the feeding means to feed said print receiving medium and said ribbon at said low feed rate such that the regions of ink layer heated by heating of said selected ones of said dot print elements in the first print cycle are reheated in the second print cycle at the predetermined time.

9. A method of thermal transfer printing including the steps of bringing a layer of ink on a thermal transfer ink ribbon into ink transfer engagement with a print receiving medium; maintaining said ink layer stationary relative to the print receiving medium during printing; feeding said ink ribbon and said print receiving medium past thermal print elements and transferring ink from said layer of ink on said ribbon to said print receiving medium by selectively heating said thermal print elements to heat selected areas of said layer of ink and including the step in a first printing cycle of heating each of said selected areas by heating selected ones of said thermal print elements to transfer ink from said selected areas to said print receiving medium; the step of controlling feeding of said ribbon and said print receiving medium so that in a second printing cycle subsequent to said first printing cycle re-heating of said selected ones of said thermal printing elements effects re-heating of ink remaining in said selected areas after said first printing cycle to transfer ink from said ink remaining in said selected areas to said print receiving medium to produce a high quality print impression on said print receiving medium.

10. A method of thermal transfer printing as claimed in claim 9 wherein re-heating of said selected ones of said thermal printing elements in the second printing cycle is effective to heat a part of each of said selected areas.

11. A thermal transfer printing device comprising a plurality of dot print elements disposed in a row; feeding means to feed a print receiving medium past said row of dot print elements in a direction transverse to said row of print elements; ribbon guiding means to guide a thermal transfer ink ribbon between said row of print elements and said print receiving medium, said thermal transfer ink ribbon having an ink layer located in ink transfer relationship with said print receiving medium; means to maintain said print receiving medium in engagement with said ink layer of said ribbon adjacent said row of print elements and to feed said ribbon with said print receiving medium and at a speed equal to that at which said print receiving a medium is fed past said row of print elements; memory means to store a plurality of print data signals corresponding respectively to said plurality of print elements and defining those ones of said plurality of print elements to be heated to print dots at selected positions in a row on said print receiving medium; resolution means operable to select high and low resolution printing; means operative in response to selection of high resolution printing by said resolution means to control said feeding means to feed the print receiving medium and the ribbon at a low speed past said print elements and to read out said print data signals in a first printing cycle to heat said selected ones of said elements to effect transfer of ink from regions of said ink layer heated by said selected elements to said print receiving medium to print said dots thereon in positions corresponding to said selected print elements and to read out said print data signals again to re-heat said selected ones of said print elements to re-heat said regions of said ink layer in a second print cycle to effect transfer to said printed dots on said print receiving medium in said second print cycle of ink remaining in said regions after heating of said regions in said first print cycle.

12. A thermal transfer printed device comprising a plurality of dot print elements disposed in a row; feeding means to feed a print receiving medium past said row of dot print elements in a direction transverse to said row of print elements; ribbon guiding means to guide a thermal transfer ink ribbon between said row of print elements and said print receiving medium; said thermal transfer ink ribbon having an ink layer located in ink transfer relationship with said print receiving medium; means to maintain said print receiving medium in engagement with said ink layer of said ribbon adjacent said row of print elements and to feed said ribbon with said print receiving medium and at a speed equal to that at which said print receiving medium is fed past said row of print elements; memory means to store a plurality of print data signals corresponding respectively to said plurality of print elements and defining those ones of said plurality of print elements to be heated to print dots at selected positions in a row on said print receiving medium; writing means to write into said memory means print data signals relating to a row of dots to be printed; resolution means operable to select high and low resolution printing; means operative in response to selection of high resolution printing by said resolution means to control said feeding means to feed at low speed past said print elements and to read out from the print receiving medium and the ribbon said memory means said print data signals in a first printing cycle to heat first selected ones of said elements to effect transfer of ink from first regions of said ink layer heated by said selected elements to said print receiving medium to print first dots thereon in positions corresponding to said first selected ones of said print elements and to read out from said memory means said print data signals again to re-heat said first selected ones of said print elements in a second print cycle to effect transfer to said first dots on said print receiving medium of ink remaining in said first regions after heating of said first regions in said first print cycle and operative in response to selection of low resolution printing to control said feeding means to feed said print receiving medium and the ribbon at a high speed greater than said low speed past said print elements and in a first printing cycle to read out from said memory means print data signals relating to said first dots to be printed in a first row on said print receiving medium to effect heating of said first selected ones of said print elements to effect transfer of ink from said first regions of said ink layer heated by said first selected ones of said print elements to print said first dots in said first row on said print receiving medium and in a second printing cycle to read out from said memory means print data signals relating to second dots to be printed in a second row on the print receiving medium to effect heating of second selected ones of said print elements to effect transfer of ink from second regions of said ink layer heated by said second selected ones of said print elements to print said second dots in said second row on said print receiving medium.

* * * * *